US006179147B1

(12) United States Patent
Mogard et al.

(10) Patent No.: US 6,179,147 B1
(45) Date of Patent: Jan. 30, 2001

(54) CLOSURE WITH FLUSH-FORMED BARRIER MEMBRANE HAVING SELECTIVELY THINNED EDGE REGIONS

(75) Inventors: Jens Mogard, Buffalo Grove, IL (US); Bengt Bengtsson, Woodbury, MI (US); Kenneth Nortman, Black River Falls, WI (US)

(73) Assignee: Tetra Laval Holdings & Finance, SA, Pully (SE)

( * ) Notice: Under 35 U.S.C. 154(b), the term of this patent shall be extended for 0 days.

(21) Appl. No.: 09/325,332

(22) Filed: Jun. 3, 1999

(51) Int. Cl.[7] ..... B65D 5/74; B65D 41/50

(52) U.S. Cl. ..... 220/258; 220/268; 220/270; 229/125.15; 222/541.5; 222/541.9; 222/556

(58) Field of Search ..... 220/254, 258, 220/259, 265, 270, 266, 268; 229/125.04, 125.05, 125.14, 125.15; 222/541.9, 541.6, 541.1, 541.5, 556

(56) References Cited

U.S. PATENT DOCUMENTS

| | | | |
|---|---|---|---|
| 4,669,640 | 6/1987 | Ando et al. . | |
| 4,986,465 | 1/1991 | Jacobsson et al. . | |
| 5,065,938 | 11/1991 | Anderson . | |
| 5,101,999 | 4/1992 | Robichaud et al. . | |
| 5,110,041 | 5/1992 | Keeler . | |
| 5,133,486 * | 7/1992 | Moore et al. | 229/125.05 X |
| 5,176,300 * | 1/1993 | Kishikawa et al. | 220/265 X |
| 5,735,426 * | 4/1998 | Badcock et al. | 220/258 |
| 5,765,747 * | 6/1998 | Lawson | 229/125.04 X |
| 5,799,840 * | 9/1998 | Mogard | 220/258 X |
| 5,839,627 * | 11/1998 | Hicks et al. | 222/541.9 |
| 5,934,496 * | 8/1999 | Mogard et al. | 220/258 |
| 5,957,312 * | 9/1999 | Adams et al. | 220/258 X |

FOREIGN PATENT DOCUMENTS

| | | | |
|---|---|---|---|
| 5-4639 * | 1/1993 | (JP) | 229/125.04 |

* cited by examiner

*Primary Examiner*—Nathan J. Newhouse
(74) *Attorney, Agent, or Firm*—Welsh & Katz, Ltd.

(57) ABSTRACT

A closure for a package that is adapted for mounting to a surface of the package includes a mounting flange having substantially planar upper and lower surfaces that define a thickness and define a flange plane. A spout extends from the upper surface of the flange and has an inner wall defining a dispensing opening. A membrane has a central portion and a circumferential edge region and is formed in the spout so as to extend to the inner wall to define a spout seal. The membrane is severable from the spout at the edge region. The edge region is selectively thinned and has a pair of first thickness regions and a pair of second thickness regions interposed between the first thickness regions. The second thickness regions have a thickness that is greater than a thickness of the first thickness regions.

23 Claims, 3 Drawing Sheets

CLOSURE WITH FLUSH-FORMED BARRIER MEMBRANE HAVING SELECTIVELY THINNED EDGE REGIONS

FIELD OF THE INVENTION

This invention pertains to spouts for container closures. More particularly, the invention pertains to a flush-formed barrier membrane having selectively thinned edge regions that is formed within a closure spout for use in packaging.

BACKGROUND OF THE INVENTION

Consumers have come to widely recognize and accept molded spouts as dispensing ports in packaging. One example, is the common gable top carton which is formed from a composite of paperboard and polymeric materials for the storage of, for example, liquid food products such as juice and milk. In an effort to provide maximum resealability of such packages, the industry has gone to using molded spouts mounted to the packages. These spouts can include threaded or snap-type, e.g., flip-cap, closures to provide maximum resealability of the package. These closures reduce the amount of degradation, i.e., spoilage, of the food product by reducing the exposure of the container contents to oxygen and airborne contaminants.

Known spout arrangements can also be used to provide tamper evidence or tamper indication as to whether the container has been opened, and the contents tampered with or altered in any way. In one known arrangement, a membrane is formed within the spout to seal the container contents from the environs. In order to access the container contents, the membrane must be removed from the spout. In one commonly used arrangement, a pull ring is formed as part of the membrane to facilitate removing the membrane from the spout.

While this arrangement has become accepted by the consuming public and has come into wide spread use in the packaging industry, there are a number of drawbacks. First, the membrane must be formed so that it is readily removed with a limited, predetermined amount of force required to pull the pull ring to remove the membrane. That is, the membrane must be sufficiently thin so that it can be readily severed and pulled from the spout. On the other hand, the membrane must have sufficient strength, generally correlative to thickness, so that it does not fracture or tear during, for example, mounting the closure to the package material or transport or the filled package, prior to initial use of the package.

Additionally, known spout-type packaging generally includes a tubular spout portion that extends upwardly from a flange that is mounted to the package. The membrane is formed intermediate the upper and lower ends of the spout, that is, of the flange and below the top end of the spout. In such an arrangement, the region between the membrane and the bottom of the spout, about coplanar with the flange, creates a pocket and thus an opportunity for bacterial growth, in that this pocket below the membrane can be difficult to sterilize.

Accordingly, there continues to be a need for closure spout barrier membrane that enhances the ability to pasteurize or sterilize the product, to maintain the necessary hygienic standards. Desirably, such a membrane maintains its integrity during the process of mounting the spout to the package, and is readily removable from the spout for easy access to the container contents.

SUMMARY OF THE INVENTION

A molded closure for a package is adapted for mounting to a surface of the package. The closure includes a flange for mounting to the surface of the package. The flange has substantially planar upper and lower surfaces and defines a thickness and flange plane. A spout extends from the upper surface of the flange and has an inner periphery that defines a dispensing opening.

A removable membrane is disposed in the dispensing opening and extends to the inner periphery of the spout to define a spout seal. The membrane a central portion and a circumferential edge region. Preferably, the membrane is formed substantially flush with the flange and has a selectively thinned edge region. The selectively thinned edge region has a first thickness and a second thickness that is greater than the first thickness. The first and second thickness each extend circumferentially about at least one portion of the edge region adjacent one another.

In a current embodiment, the membrane edge region has two first thickness regions and two second thickness regions, each first thickness region being positioned in opposing relation to one another and between the second thickness regions. Preferably, the membrane is formed with a grasping portion formed integral with the membrane and extending from the membrane proximal to one of the first thickness regions. Most preferably, the grasping member is formed as a pull ring.

The first thickness regions each extend circumferentially about 30 degrees to about 90 degrees and the second thickness regions each extend circumferentially about 150 degrees to about 90 degrees. Preferably, the first thickness regions each extend circumferentially about 60 degrees and the second thickness regions each extend circumferentially about 120 degrees.

A preferred closure includes a cap for engaging and sealing the spout. The cap can be hingedly mounted to the closure as in a flip or snap-type cap. The pull ring can be formed at an upward angle relative to the membrane, and the closure can include a cap that has a top wall portion that is formed at an upward angle to accommodate the pull ring when the cap is in a closed position.

Other features and advantages of the present invention will be apparent from the following detailed description, the accompanying drawings, and the appended claims.

DETAILED DESCRIPTION OF THE PREFERRED EMBODIMENTS

Figure 1:
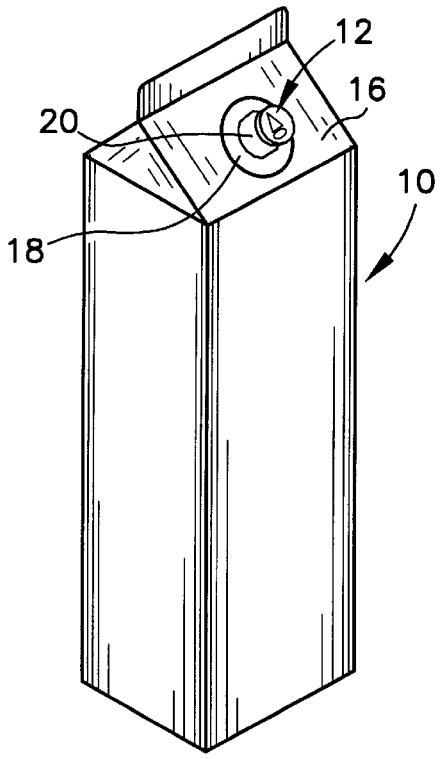
FIG. 1 is a perspective view of an exemplary gable top package having a spout-type closure with a flush-formed barrier membrane having selectively thinned edge regions in accordance with the principles of the present invention.
Figure 2:
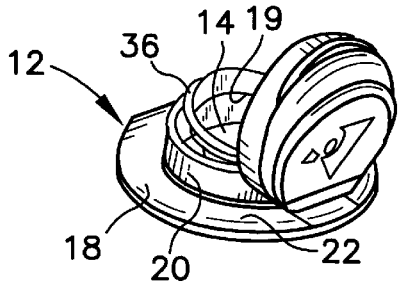
FIG. 2 is a perspective view of an exemplary flip-cap or snap-cap closure having a flush-formed membrane with selectively thinned edge regions, the closure being illustrated in the open position.
Figure 3:
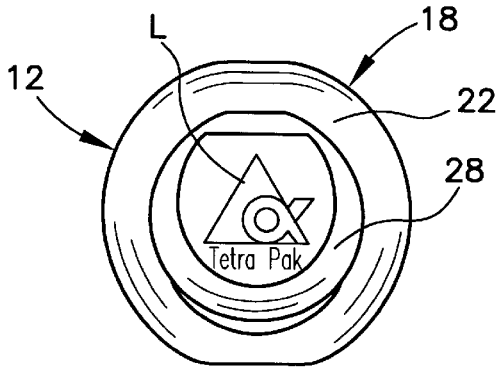
FIG. 3 is a top view of the closure of FIG. 2.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures and in particular to FIG. 1, there is shown a package 10 having a spout-type closure 12 with a barrier membrane 14 in accordance with the principles of the present invention. The exemplary closure 12 can be mounted to a readily recognizable package such as the illustrated gable top carton 10. Those skilled in the art will recognize that the present closure 12 can be mounted to a wide variety of packaging type as well as packaging materials, and such uses are within the scope of the present invention.

Figure 4A:
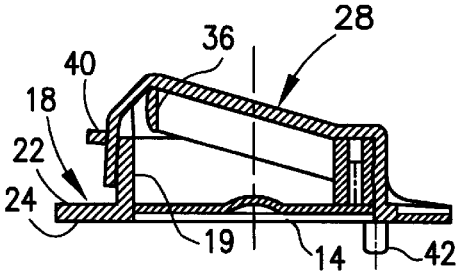
FIGS. 4*a*–4*c* are cross-sectional view of the closure of FIG. 3, with the closure shown in the fully closed position, the partially opened position and the fully opened position, in the respective views, the closure being shown with a pull-ring formed as part of the membrane.
Figure 4B:
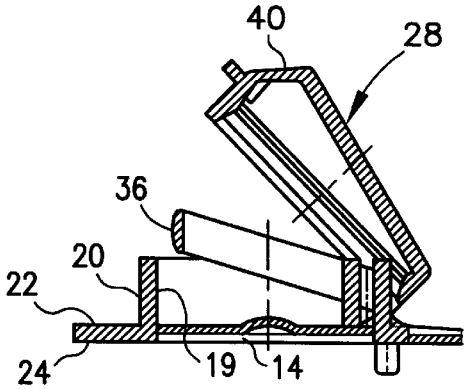
Figure 4C:
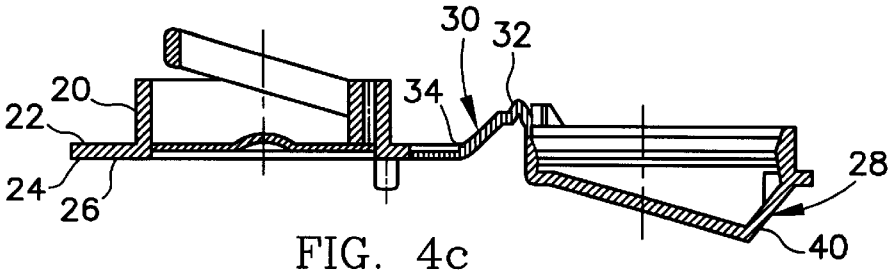

In a typical configuration, the closure 12 is mounted to a gable panel 16 of the gable top carton or package 10. The closure 12 includes a flange 18 by which it is mounted to the carton panel 16 or generally to the package 10 material. An upstanding spout 20 having a generally cylindrical shape extends from a side 22 of the flange 18 that is mounted to the carton panel 16. An opposite side 24 of the flange 18 is oriented inwardly of the package 10. Referring briefly to FIGS. 4*a*–c, the membrane 14 is formed within the spout 20, and is formed substantially coplanar with the flange 18. That is, the membrane 14 is formed at about the base 26 of the spout 20 substantially flush with the flange 18. The membrane 14 extends across the spout 20 to the inner periphery thereof.

The closure 12 illustrated in FIGS. 2–7 is a snap-type closure. The closure 12 includes a cap portion 28 that covers the pour spout 20. The cap 28 is hingedly mounted to the flange 18 by a dual-action hinge 30. A first hinge member 32 pivots the cap 28 relative to the spout 20, and a second hinge member 34 pivots the cap 28 relative to the flange 18 to fully position the cap 28 out of the way of the spout 20 and the flow stream of the contents from the package 10.

As discussed herein, the membrane 14, is formed with an extension, such as the exemplary pull ring 36, to facilitate pulling and removing the membrane 14 from the spout 20. The pull ring 36 is formed integral with the membrane 14 to assure that pulling on the ring 36 will consequently break and remove the membrane 14 from the spout 20, rather than sever or break the ring 36.

In the arrangement illustrated, the pull ring 36 is formed at an angle relative to the membrane 14 so that it extends above the spout 20 when the cap 28 is opened. This configuration facilitates readily grasping the ring 36 to remove the membrane 14. In a preferred closure 12, the cap 28 has an upwardly angled top wall 38, from which depends an enlarged or heightened front wall 40. This configuration accommodates the upwardly angled pull ring 36 in its relaxed state, without creating undue stresses in the pull ring 36 and the membrane 14 at the pull ring-membrane juncture when the cap 28 is closed as shown in FIG. 4*a*.

The flush-formed membrane 14 configuration provides a number of advantages over known, raised membrane spouts. In particular, as can be seen from FIG. 4*a*, the substantially flush-formed membrane 14 greatly reduces or eliminates regions or pockets within the spout 20, below the membrane 14, in which product can collect, and in which bacterial growth can result. It has, however, been observed that in attempts to mount such a flange-flush membrane closure 12 to the package 10 material, the membrane, particularly at those areas immediately adjacent to the spout, fractures or otherwise breaks. Such degradation and loss of structural integrity of the membrane can result in, among other things, an improper or incomplete seal between the package contents and the environs. This incomplete seal can result in spillage or contamination of the container contents.

Those skilled in the art will recognize that one common method of mounting the closure 12 to the container 10 material is through the use of ultrasonic welding techniques. In such welding processes, the articles being welded, e.g., the closure 12 particularly at the flange 18, and the package 10 material to which it is welded, can be subjected to extreme forces resulting from vibration and shock. These forces increase the tendency for fracture or breakage of the membrane.

Figure 5:
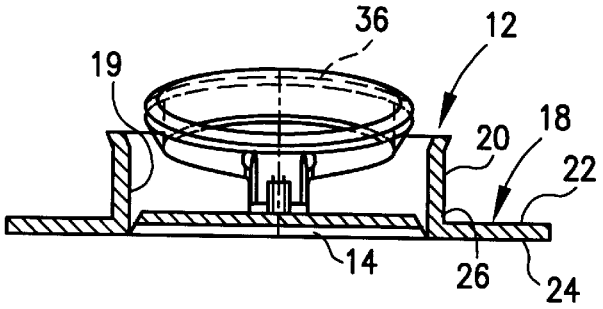
FIG. 5 is a rear cross-sectional view taken across the closure spout and flange, and illustrating the positional relation of the membrane, spout and flange.
Figure 6:
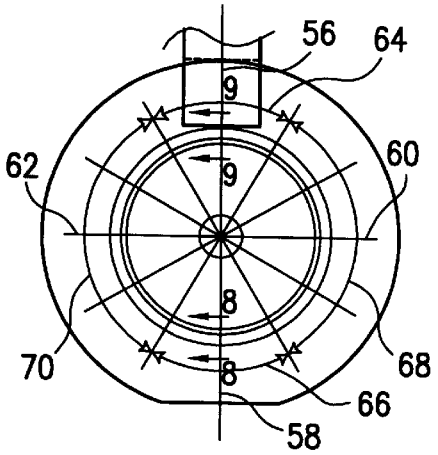
FIG. 6 is a top view of the spout portion of the closure of FIG. 5, with the pull ring removed for clarity of illustration.
Figure 7:
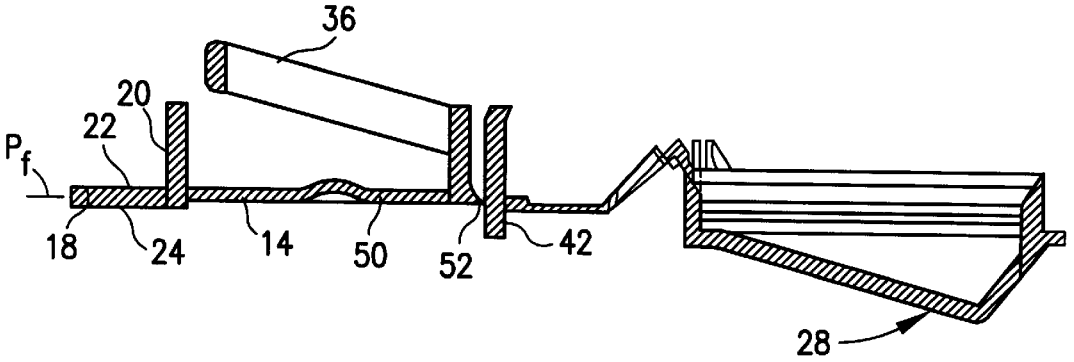
FIG. 7 is an enlarged cross-sectional view similar to FIG. 4*c*.
Figure 8:
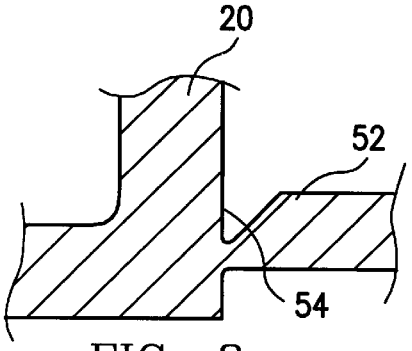
FIG. 8 is an enlarged cross-sectional view of the flush-formed membrane-spout juncture taken at about the front portion of that juncture.
Figure 9:
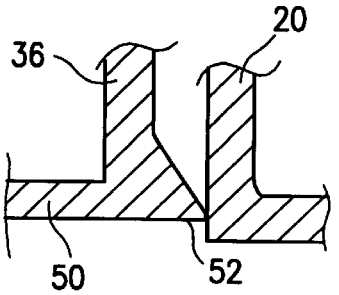
FIG. 9 is an enlarged cross-sectional view of the flush-formed membrane-spout juncture taken at about the rear portion of that juncture, and illustrating the pull-ring formed as part of the membrane.

To this end, as shown in FIG. 5, a membrane 14 formed in accordance with the principles of the present invention includes a central portion or region 50 and a peripheral edge region 52. The peripheral edge region 52 defines a plurality of areas in which the thickness of the membrane 14 at these regions differs from other areas at the edge region 52, that is, at the membrane-spout juncture, as indicated at 54. In the illustrated embodiment, the membrane edge region 52 is formed with two different areas or regions of thickness.

Reference will now be made to the membrane 14 relative to a clock face, in which the twelve o'clock position (as indicated at 56), represents an uppermost portion of the membrane 14, at a location where the pull ring 36 is formed integral with the central portion 50 of the membrane 14. The membrane edge 52 has thinned regions at the 12 o'clock and 6 o'clock positions, 56, 58, respectively. Conversely, the membrane 14 has thickened edge regions 52 at about the 3 o'clock and 9 o'clock positions, 60, 62, respectively. Essentially, the membrane edge 52 is thickened at about the central peripheral regions, namely, the 3 o'clock and 9 o'clock regions, 60, 62, so that the flush-formed membrane 14 withstands the forces exerted thereon during the ultrasonic welding process.

In a present embodiment, the upper thinned region 64 extends between about 10:30 o'clock and about 1:30 o'clock at the top (as indicated at 64) and preferably extends about 60 degrees between about 11 o'clock and about 1 o'clock. The lower thinned region extends between about 4:30 o'clock and about 7:30 o'clock at the bottom (as indicated at 66) and preferably extends about 60 degrees between about 5 o'clock and about 7 o'clock.

The side thickened regions extend between about 6:30 o'clock and about 11:30 o'clock on one side, and between about 12:30 o'clock and about 5:30 o'clock on the other side. Preferably, each of the side thickened regions extends about 120 degrees, with one side extending between about 1 o'clock and about 5 o'clock (as indicated at 68), and the other side extending between about 7 o'clock and about 11 o'clock (as indicated at 70).

In a current embodiment, the thickness of the thinned regions 64, 66 is about 0.17 millimeters (mm) to about 0.21 mm, and preferably about 0.18 mm, and the thickness of the thickened regions 68, 70 is about 0.27 mm to about 0.37 mm, and preferably about 0.28 mm.

It has been observed that the novel selectively thinned edge region membrane 14 provides a number of advantages over known membrane configurations. First, the present membrane 14 exhibits increased oxygen barrier characteristics up to about 40 percent. This increased oxygen barrier characteristic is achieved without increasing the actual "pull-out" force required to remove the membrane 14.

Because the membrane 14 is thinner at the upper and lower regions 64, 66, when a consumer grasps the pull ring 36 and begins to remove the membrane 14, that is, when the consumer initially breaks the membrane 14 at the upper region 64, there is little to no noticeable increase in pull-out force required because this region 64 is thinned. As the consumer continues to pull the ring 36 to remove the membrane 14, there is no noticeable increase in force required to severe the membrane 14 at the thicker side regions 68, 70, because the force required to initially "break" the membrane 14 is greater than the force required to continue tearing the membrane 14. Once the consumer has pulled the membrane 14 beyond the thicker side regions 68, 70 to the thinner bottom region 66, that is, near where the tear ends, the reduced thickness once again permits the consumer to readily remove the entirety of the membrane 14 from the spout 20.

As discussed above, the present membrane 14 also permits a substantially flush formation of the membrane 14 relative to the flange 18, thus reducing or eliminating the formation of pockets within the spout 20. This is desirable in that it enhances the ability to pasteurize or otherwise sterilize the product in the package 10, and thus reduces the opportunity for bacterial growth or other contamination.

Prior attempts to mold a flush-formed membrane, that is a membrane formed substantially flush with the closure mounting flange, have failed due to the unacceptable incidence of membrane fracture. In welding the closure to the package material, the closure and material can be subjected to extreme forces resulting from vibration and shock. This is particularly true at the welding site, near the flange. Because of the proximity of the membrane to the flange, the forces can be so great that membrane-spout juncture fracture occurs.

The present membrane 14 configuration, that is formed with a varying thickness at the edge region 52, overcomes these difficulties. The present membrane 14 not only permits a substantially flush-formed configuration to reduce "pockets", but also provides a configuration by which a consumer will notice minimal if any increase in "pull-out" force required to remove the membrane 14, even though portions 68, 70 of the membrane 14 have been thickened over known spout membranes.

Figure 11:
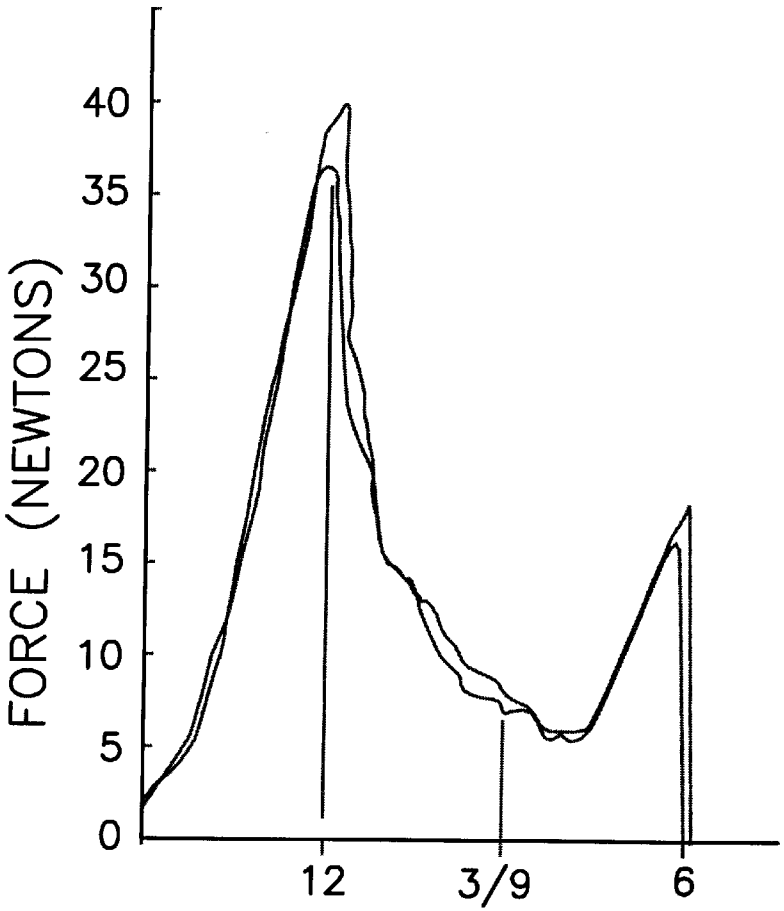
FIG. 11 is a graphical representation of the pull-out force required to remove a known even-thickness membrane, the force required being shown along the ordinate and represented in newtons (N), and the position of tear of the membrane being shown along the abscissa and represented by position relative to a clock face, with the commencement of tear at the twelve o'clock position.
Figure 10:
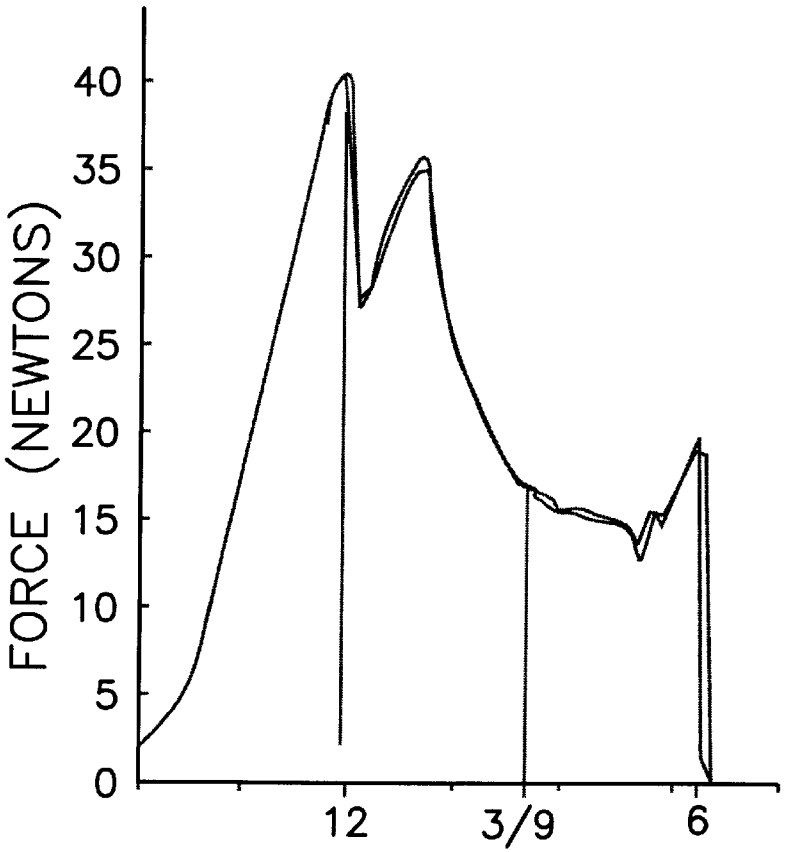
FIG. 10 is a graphical representation of the pull-out force required to remove a membrane having selectively thinned edge regions in accordance with the present invention, the force required being shown along the ordinate and represented in newtons (N), and the position of tear of the membrane being shown along the abscissa and represented by position relative to a clock face, with the commencement of tear at the twelve o'clock position.

FIGS. 10 and 11 represent graphical illustrations comparing the force required to remove (i.e., the "pull-out" force) of the present membrane 14 (FIG. 10) to a known, even-thickness membrane (FIG. 11). In each of the figures, the force is shown along the ordinate (the y-axis) in Newtons, and the position about the membrane 14, relative to a clock face is shown along the abscissa (the x-axis). In each of the figures, the "breaking" force, which is the force required to commence removing the membrane 14, or initially "breaking" the membrane 14 is shown at the first peak 12 o'clock position. Conversely, the completion of or final removal of the membrane 14 is shown at the second peak at the 6 o'clock position.

Referring to the figures, it will be seen that the force required to commence removing the membrane, i.e., "break", the membrane of the present invention is about 8 percent more than a known, even-thickness membrane; about a 40 newton (N) force is required to commence removing the present membrane, compared to about a 37 N force for the even-thickness membrane. The force required to continue tearing or removing the present membrane is about 17 N at the 3 o'clock/9 o'clock position compared to a force of about 8 N for the known membrane. Although this appears to be a significant difference, when taken in context, and considering that is a less than one-half of the initial "breaking" force, it is still at an acceptable level. Continuing on, at the completion of removal, at the 6 o'clock position, the present membrane and the known membrane require about the same force, about 8 N to complete removal. It has been observed that the increased pullout force exhibited at about the middle of the membrane 14 removal cycle is minimally, if at all noticeable by the average consumer in removing the membrane.

As set forth above, various types of spout-type closures can benefit from the present flush-formed membrane 14. Closures 12 that include a snap-type cap 28, such as that illustrated in FIGS. 2–7, are orientationally sensitive in that they must be mounted to the package 10 in a particular orientation so that, for example, the cap 28 flips upwardly, away from the direction in which the contents are poured, or indicia, such as the illustrated logo L is properly oriented. To this end, these closures 12 can be formed with orienting projections, such as the depending, projection 42 that extends from the flange side 24 opposingly from the spout 20. It will be readily recognized that orienting elements such as the projection 42 can be formed without interfering with the formation and/or mounting of the present closure 12.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A molded closure for a package, the closure adapted for mounting to a surface of the package, comprising:

a flange having substantially planar upper and lower surfaces and defining a thickness, the flange defining a plane;

a spout extending from the upper surface of the flange, the spout having an inner periphery defining a dispensing opening therethrough; and a removable membrane having a central portion and a circumferential edge region, the membrane being formed in the spout so as to extend to the inner periphery of the spout at the edge region to define a spout seal, the edge region having a first thickness and a second thickness that is greater than the first thickness, the first and second thickness each extending circumferentially about at least one portion of the edge region adjacent one another, the membrane being fully removable from the spout at the circumferential edge region.

2. The molded closure in accordance with claim 1 wherein the membrane is formed in the spout about flush with the flange.

3. The molded closure in accordance with claim 1 including a grasping portion formed integral with the membrane and extending from the membrane proximal to the first thickness region.

4. The molded closure in accordance with claim 3 wherein the grasping portion is formed as a pull ring.

5. The molded closure in accordance with claim 1 including a cap for engaging and sealing the spout.

6. The molded closure in accordance with claim 5 wherein the cap is hingedly mounted to the closure.

7. The molded closure in accordance with claim 1 wherein the membrane edge region has two first thickness regions positioned in opposing relation to one another.

8. The molded closure in accordance with claim 3 wherein the edge region has two second thickness regions positioned in opposing relation to one another, each being positioned intermediate the first thickness regions.

9. The molded closure in accordance with claim 8 wherein the first thickness regions each extend circumferentially about 45 degrees to about 90 degrees and the second thickness regions each extend circumferentially about 90 degrees to about 150 degrees.

10. The molded closure in accordance with claim 9 wherein the first thickness regions each extend circumferentially about 60 degrees and the second thickness regions each extend circumferentially about 120 degrees.

11. The molded closure in accordance with claim 8 wherein the membrane is formed in the spout about flush with the flange.

12. The molded closure in accordance with claim 11 including a grasping portion formed integral with the membrane and extending from the membrane proximal to one of the at least one first thickness regions.

13. The molded closure in accordance with claim 12 wherein the grasping member is formed as a pull ring.

14. A closure for a package, the closure adapted for mounting to a surface of the package, comprising:

a flange having substantially planar upper and lower surfaces and defining a thickness, the flange defining a plane;

a spout extending from the upper surface of the flange, the spout having an inner wall defining a dispensing opening therethrough; and a membrane having a central portion and a circumferential edge region, the membrane being formed in the spout so as to extend to the inner wall of the spout at the edge region to define a spout seal, the membrane being severable from the spout at the edge region, the edge region having a pair of first thickness regions and a pair of second thickness regions interposed between the first thickness regions, the second thickness regions having a thickness that is greater than a thickness of the first thickness regions.

15. The closure in accordance with claim 14 wherein the membrane is formed in the spout about flush with the flange.

16. The molded closure in accordance with claim 14 wherein the first thickness regions each extend circumferentially about 45 degrees to about 90 degrees and the second thickness regions each extend circumferentially about 90 degrees to about 150 degrees.

17. The molded closure in accordance with claim 14 wherein the first thickness regions each extend circumferentially about 60 degrees and the second thickness regions each extend circumferentially about 120 degrees.

18. The closure in accordance with claim 14 including a cap for engaging and sealing the spout.

19. The closure in accordance with claim 18 wherein the cap is hingedly mounted to the closure.

20. The closure in accordance with claim 14 including a grasping portion formed integral with the membrane and extending from the membrane proximal to one of the first thickness regions.

21. The closure in accordance with claim 20 wherein the grasping member is formed as a pull ring.

22. The closure in accordance with claim 21 wherein the pull ring is formed at an upward angle relative to the membrane.

23. The closure in accordance with claim 22 wherein the cap includes a top wall portion formed at an upward angle to accommodate the pull ring when the cap is in a closed position.

* * * * *